US007796899B2

(12) United States Patent
Akashima

(10) Patent No.: US 7,796,899 B2
(45) Date of Patent: Sep. 14, 2010

(54) IMAGE FORMING SYSTEM AND USE STATUS DISPLAY PROGRAM

(75) Inventor: Tomoyuki Akashima, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 218 days.

(21) Appl. No.: 12/047,840

(22) Filed: Mar. 13, 2008

(65) Prior Publication Data

US 2008/0226329 A1 Sep. 18, 2008

(30) Foreign Application Priority Data

Mar. 15, 2007 (JP) ..... 2007-066734

(51) Int. Cl.
*G03G 15/00* (2006.01)

(52) U.S. Cl. ..... 399/8; 399/12

(58) Field of Classification Search ..... 358/1.13, 358/1.15; 399/8, 12, 87
See application file for complete search history.

(56) References Cited

U.S. PATENT DOCUMENTS

| | | | | |
|---|---|---|---|---|
| 6,856,413 | B1 | 2/2005 | Roosen et al. | |
| 7,002,702 | B1 * | 2/2006 | Machida | 358/1.15 |
| 7,437,436 | B2 | 10/2008 | Higuchi | |
| 2002/0105671 | A1 | 8/2002 | Sugahara | |
| 2006/0026600 | A1 | 2/2006 | Yoshida | |

FOREIGN PATENT DOCUMENTS

| | | |
|---|---|---|
| JP | 07-221890 | 8/1995 |
| JP | 10-063451 | 3/1998 |
| JP | 11-134142 | 5/1999 |
| JP | 11-327848 | 11/1999 |
| JP | 2000-357065 | 12/2000 |
| JP | 2001-216242 | 8/2001 |
| JP | 2001-312433 | 11/2001 |
| JP | 2004-110181 | 4/2004 |
| JP | 2005-149089 | 6/2005 |
| JP | 2006-041940 | 2/2006 |

OTHER PUBLICATIONS

Japanese Office Action Reference No. PBR03165. Dispatch No. 790847. Dated Jan. 6, 2009.
Decision of Refusal for Japanese Application No. 2007-066734 dated Apr. 7, 2009.

* cited by examiner

*Primary Examiner*—Hoang Ngo
(74) *Attorney, Agent, or Firm*—Banner & Witcoff, Ltd

(57) ABSTRACT

An image forming system includes: a computer; an image forming apparatus configured to be coupled to the computer; an inquiry unit which inquires, to the image forming apparatus, about a use status thereof; an acquisition unit which acquires the use status from the image forming apparatus, to which the inquiry unit has inquired; and a display unit which displays the use status acquired by the acquisition unit distinguishably whether the image forming apparatus is controllable by the computer.

17 Claims, 6 Drawing Sheets

IMAGE FORMING SYSTEM AND USE STATUS DISPLAY PROGRAM

CROSS-REFERENCE TO RELATED APPLICATION

This application claims priority from Japanese Patent Application No. 2007-066734, filed on Mar. 15, 2007, the entire subject matter of which is incorporated herein by reference.

TECHNICAL FIELD

Aspects of the present invention relate to an image forming system which has an image forming apparatus coupled to a computer to form an image in accordance with an image forming command transmitted from the computer and which displays the use status of the image forming apparatus, and a program for the image forming system.

BACKGROUND

Related-art image forming systems display on the display screen of a computer (PC) a use status such as the operating status, trouble status, and printing waiting time of a printer coupled to the PC (e.g., see JP-A-11-134142).

However, according to the image forming system described in JP-A-11-134142, the use status of any printers coupled to a PC would be displayed on the display screen of the PC without distinguishing between the printers. Thus, the PC cannot control a printer whose printer driver for controlling it has not yet been installed in the PC, even when the printer appears to be "printable." That is, the PC can not control printing of such printer.

SUMMARY

Exemplary embodiments of the present invention address the above disadvantages and other disadvantages not described above. However, the present invention is not required to overcome the disadvantages described above, and thus, an exemplary embodiment of the present invention may not overcome any of the problems described above.

Accordingly, it is an aspect of the present invention to provide an image forming system which can display the use status of an image forming apparatus and which displays the use status of the image forming apparatus with improved reliability.

According to an exemplary embodiment of the present invention, there is provided an image forming system comprising: a computer; an image forming apparatus configured to be coupled to the computer; an inquiry unit which inquires, to the image forming apparatus, about a use status thereof; an acquisition unit which acquires the use status from the image forming apparatus, to which the inquiry unit has inquired; and a display unit which displays the use status acquired by the acquisition unit distinguishably whether the image forming apparatus is controllable by the computer.

According to another exemplary embodiment of the present invention, there is provided an image forming system comprising: a computer; an image forming apparatus configured to be coupled to the computer; a search unit which searches an image forming apparatus controllable by the computer; an inquiry unit which inquires, to the image forming apparatus searched by the search unit, about a use status thereof; an acquisition unit which acquires the use status from the image forming apparatus, to which the inquiry unit has inquired; and a display unit which displays the use status acquired by the acquisition unit.

According to still another exemplary embodiment of the present invention, there is provided a computer-readable medium having a computer program stored thereon and readable by a computer, the computer program, when executed by the computer, causes the computer to perform operations comprising: inquiring, to an image forming apparatus, about a use status thereof; acquiring the use status from the image forming unit, to which the inquiring has been performed; and displaying the acquired use status distinguishably whether the image forming apparatus is controllable by a computer.

According to yet another exemplary embodiment of the present invention, there is provided a computer-readable medium having a computer program stored thereon and readable by a computer, the computer program, when executed by the computer, causes the computer to perform operations comprising: searching an image forming apparatus controllable by a computer; inquiring, to the searched image forming apparatus, about a use status thereof; acquiring the use status from the image forming apparatus, to which the inquiring has been performed; and displaying the acquired use status of the image forming apparatus.

According to yet another exemplary embodiment of the present invention, there is provided an image processing apparatus comprising: a controller; a connection portion configured to couple to a plurality of image forming apparatuses; a search unit which searches an image forming apparatus, which the controller is capable of controlling and is coupled to the connection portion, from among the plurality of image forming apparatuses; and an obtaining unit which obtains a use status of the image forming apparatus searched by the search unit; and a display unit which displays the use status of the image forming apparatus.

BRIEF DESCRIPTION OF THE DRAWINGS

The above and other aspects of the present invention will become more apparent and more readily appreciated from the following description of exemplary embodiments of the present invention taken in conjunction with the attached drawings, in which.

DETAILED DESCRIPTION

Now, an exemplary embodiment of the present invention will be explained below referring to the accompanying drawings. In exemplary embodiments, description will be made for an example in which a use status display program is installed in a computer coupled to a printer, thereby allowing the computer and the printer to serve as an image forming system.

First Exemplary Embodiment

1. Brief Description of Image Forming System

Figure 1:
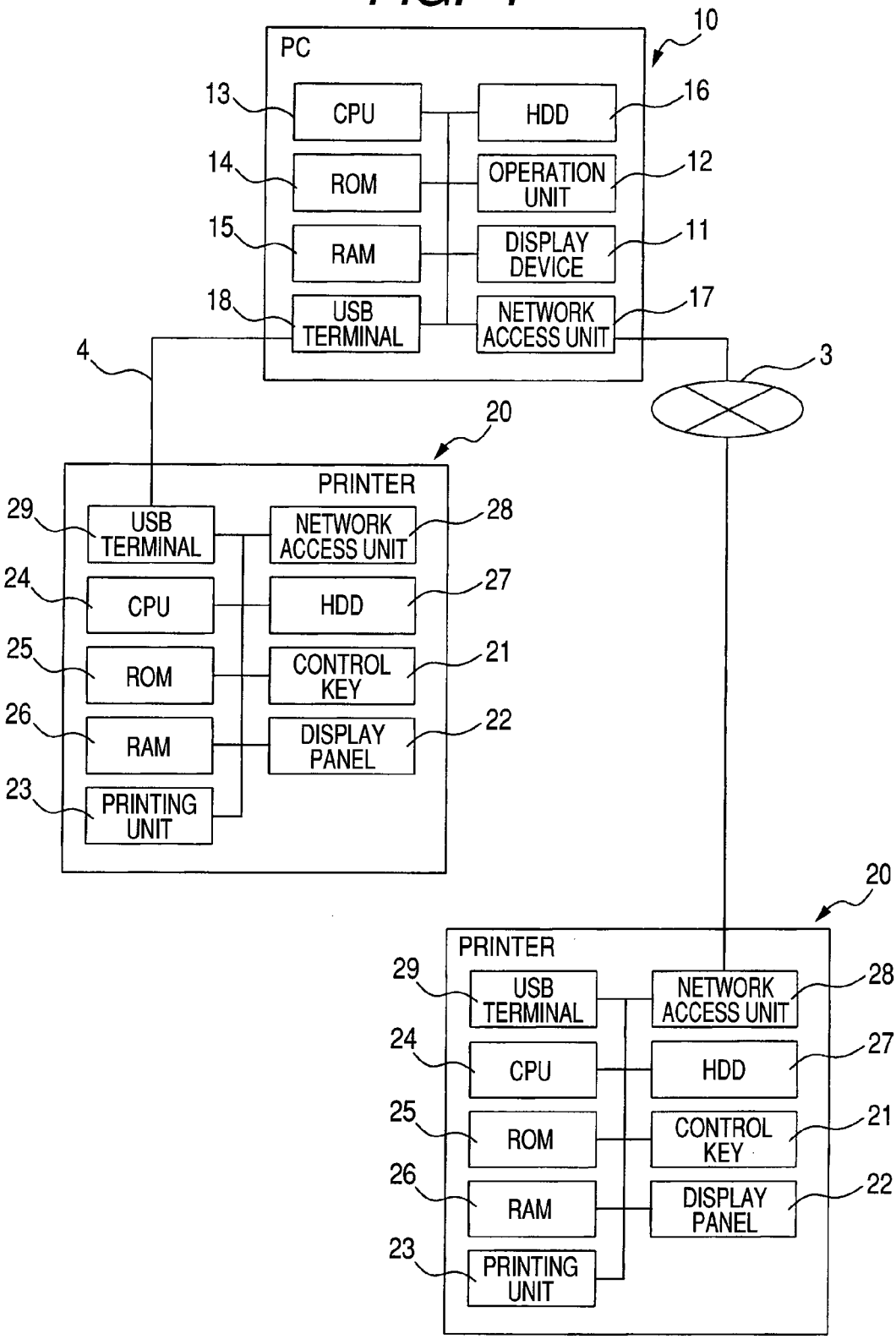
FIG. 1 is a view generally illustrating an image forming system according to an exemplary embodiment.

FIG. 1 is a view generally illustrating an image forming system according to a first exemplary embodiment. This image forming system includes a computer 10 and a plurality of printers 20, etc., coupled to the computer 10. In addition, in the description below, the computer 10 will be referred to as the PC 10.

As shown in FIG. 1, the PC 10 includes a display device 11, an operation unit 12, a CPU 13, a ROM 14, a RAM 15, an HDD 16, a network access unit 17, and a connection terminal 18, etc.

The display device 11 includes a liquid crystal display panel (LCD panel) which displays images and characters. The operation unit 12 includes a mouse (not shown) which moves a pointer (not shown) to point a particular portion on the display device 11 and a keyboard (not shown).

Furthermore, the network access unit 17 is configured to be coupled to the printer 20 via a network 3 such as the Ethernet (trademark). The connection terminal 18 is a universal serial bus (USB) compliant connection terminal through which an external device is detachably coupled to the PC 10.

The printer 20 forms an image in accordance with an image forming command transmitted from the PC 10. The printer 20 is coupled to the network access unit 17 of the PC 10 or the connection terminal 18 of the PC 10. Accordingly, in the first exemplary embodiment, there exists a printer 20 which is directly coupled to the PC 10 without the network 3 but via a USB cable 4 or the like, and a printer 20 which is coupled to the PC 10 via the network 3.

As shown in FIG. 1, the printer 20 includes control keys 21 for selecting the functions of the printer 20, a display panel 22 which displays the contents of control entries and operating conditions, and a printing unit 23 which prints characters and images on recording media such as recording sheets. The printer 20 further includes a CPU 24, a ROM 25, a RAM 26, an HDD 27, a network access unit 28 for coupling to the PC 10 via the network 3, and a USB compliant connection terminal 29 through which an external device is detachably coupled to the PC 10.

2. An Operation of Use Status Display Program (Image Forming System)

2.1. General Operation

The PC 10 of the first exemplary embodiment has a printer driver (printing control program) installed to control the printer 20 for printing. Furthermore, a use status display program is stored in the ROM 14, and the CPU 13 executes the use status display program, thereby searching a printer 20 controllable by the PC 10 among those multiple printers 20 coupled to the PC 10, i.e., a printer 20 corresponding to a printer driver installed in the PC 10.

The use status display program inquires, from the searched printer 20, status information indicating the operating status, trouble status, and use status of the printer 20, and then provides control to acquire the status information from the printer 20. Thereafter, control is provided to display the status information acquired from the printer 20 on the display device 11.

To execute the use status display program and thereby inquire the status information of the printer 20 and then display the status information acquired from the printer 20 on the display device 11 is also referred to as "to monitor the printer 20."

2.2. Control Flow of Use Status Display Program

Figure 2:
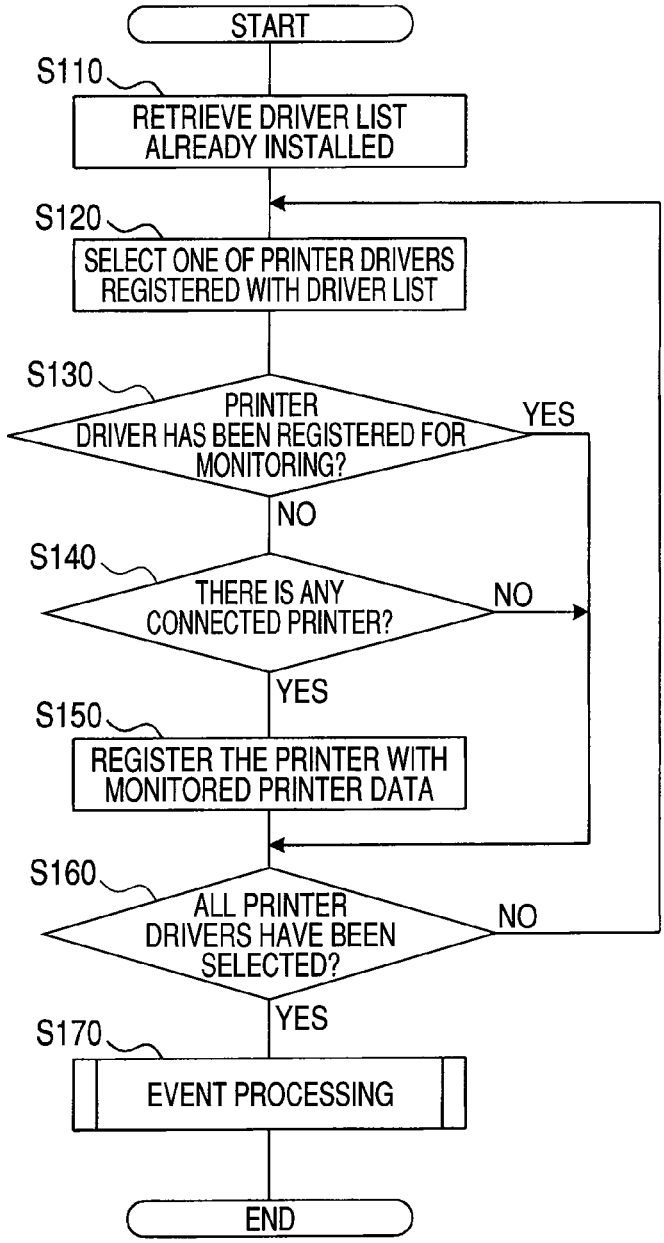
FIG. 2 is a flowchart showing an operation of a use status display program according to an exemplary embodiment.
Figure 3:
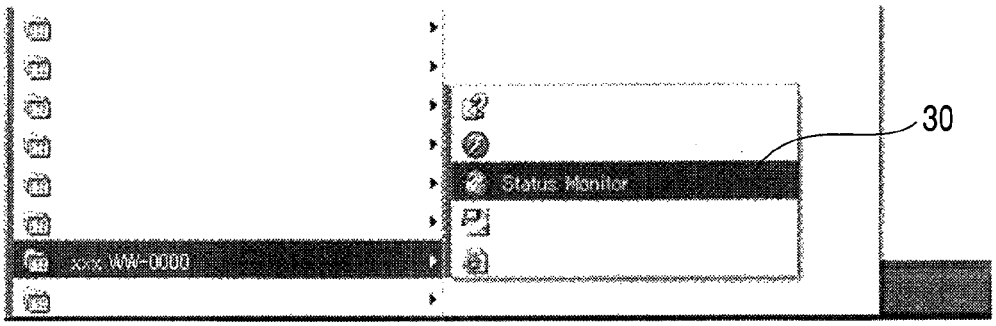
FIG. 3 is an explanatory view illustrating a menu window for starting the use status display program according to an exemplary embodiment.

FIG. 2 is a flowchart showing an operation of the use status display program executed by the PC 10 according to the first exemplary embodiment. FIG. 3 is an explanatory view illustrating a menu window for starting the use status display program according to the first exemplary embodiment. The flow of FIG. 2 starts with a user's entry through the operation unit 12 to select a highlighted portion 30 with a string "Status Monitor" on the menu window appearing on the display device 11 as shown in FIG. 3. In this regard, this exemplary embodiment employs Windows (trademark) as an operating system (OS) of the PC 10. The highlighted portion 30 constitutes part of the menu window which appears by clicking on the "Start" button with a mouse serving as the operation unit 12 or the like and then selecting "Programs." Note that an operation system is not limited to Windows or others having a graphical user interface. The present invention is also applied to system having a character user interface. Additionally, no operation system may be used.

Figure 4A:
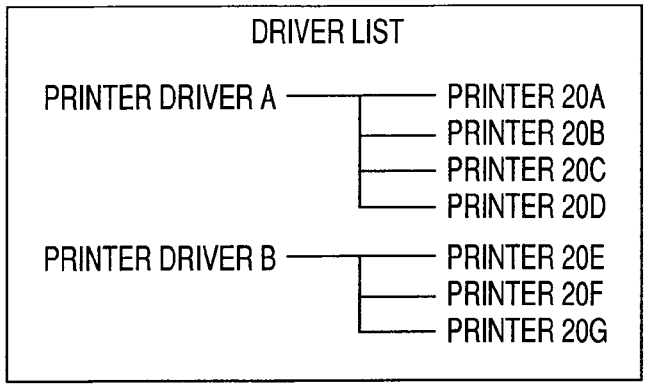
FIGS. 4A to 4D are explanatory views illustrating an operation of the use status display program according to an exemplary embodiment.

When the flow shown in FIG. 2 starts, a driver list to be discussed later is first retrieved from the HDD 16 (S110). Here, the driver list is a collection of pieces of registered information regarding the printer drivers installed in the PC 10. More specifically, as shown in FIG. 4A, when registered, all the printer drivers installed in the PC 10 are associated with the printers 20 corresponding to those printer drivers.

Then, as shown in FIG. 2, when the driver list is retrieved in process S110, one of the printer drivers registered with the driver list is selected (S120). It is then determined whether the printer 20 associated with the selected printer driver is registered with monitored printer data, to be discussed later (S130).

Here, the monitored printer data indicates a printer 20 monitored by the PC 10, and the monitored printer data is stored in the HDD 16. In this exemplary embodiment, a printer 20 currently controllable by the PC 10 via a printer driver is set as an object to be monitored (i.e., registered with the monitored printer data).

When it is determined in process S130 that a printer 20 associated with the printer driver selected in S120 is not registered with the monitored printer data (S130: NO), then it is determined whether the printer 20 corresponding to the printer driver selected in S120 is found among those printers 20 coupled to the PC 10 (S140).

That is, in process S140, it is determined whether the printer 20 controllable by the PC 10 is found among the printers 20 currently coupled to the PC 10.

When it is determined in process S140 that the printer 20 corresponding to the printer driver selected in S120 is coupled to the PC 10 (S140: Yes), the printer 20 is registered with the monitored printer data (S150). Then, it is determined whether all the printer drivers registered with the driver list have been selected (S160).

Figure 4B:
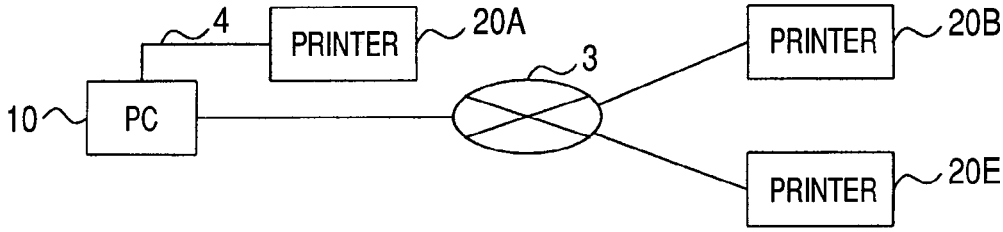

For example, as shown in FIGS. 4A and 4B, it is assumed that a printer driver A can control printers 20A, 20B, 20C and 20D and a printer driver B can control printers 20E, 20F and 20G. The printers 20A, 20B and 20E are coupled to the PC 10 but have not been registered in the monitored printer data.

In this case, when the printer driver A is selected in process S120, the printers 20A and 20B are registered with the monitored printer data in process S150. When the printer driver B is selected in process S120, the printer 20E is registered with the monitored printer data in process S150.

Figure 4C:
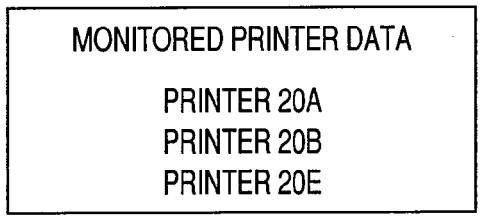

That is, when the printers 20A, 20B, and 20E are coupled to the PC 10 in which the printer driver A and the printer driver B are installed, the printers 20A, 20B, and 20E are registered with the monitored printer data as shown in FIG. 4C.

Furthermore, it may be determined in process S130 that the printer 20 corresponding to the printer driver selected in S120 has been registered with the monitored printer data (S130: Yes), or it may be determined in process S140 that the printer 20 corresponding to the printer driver selected in S120 is not coupled to the PC 10 (S140: No). In this case, since there is no printer 20 additionally registered with the monitored printer data, process S150 is skipped and then process S160 is executed.

When it is determined in process S160 that all the printer drivers registered with the driver list have not yet been selected (S160: No), the process returns to S120, where one of those printer drivers that have been registered with the driver list but not yet selected is selected (S120).

On the other hand, when it is determined in process S160 that all the printer drivers have been selected (S160: Yes), event processing for monitoring the printers 20 having been registered with the monitored printer data (for further details, see FIG. 5 to be discussed later) is executed (S170) Then, the flow ends.

2.3. Event Processing

Figure 5:
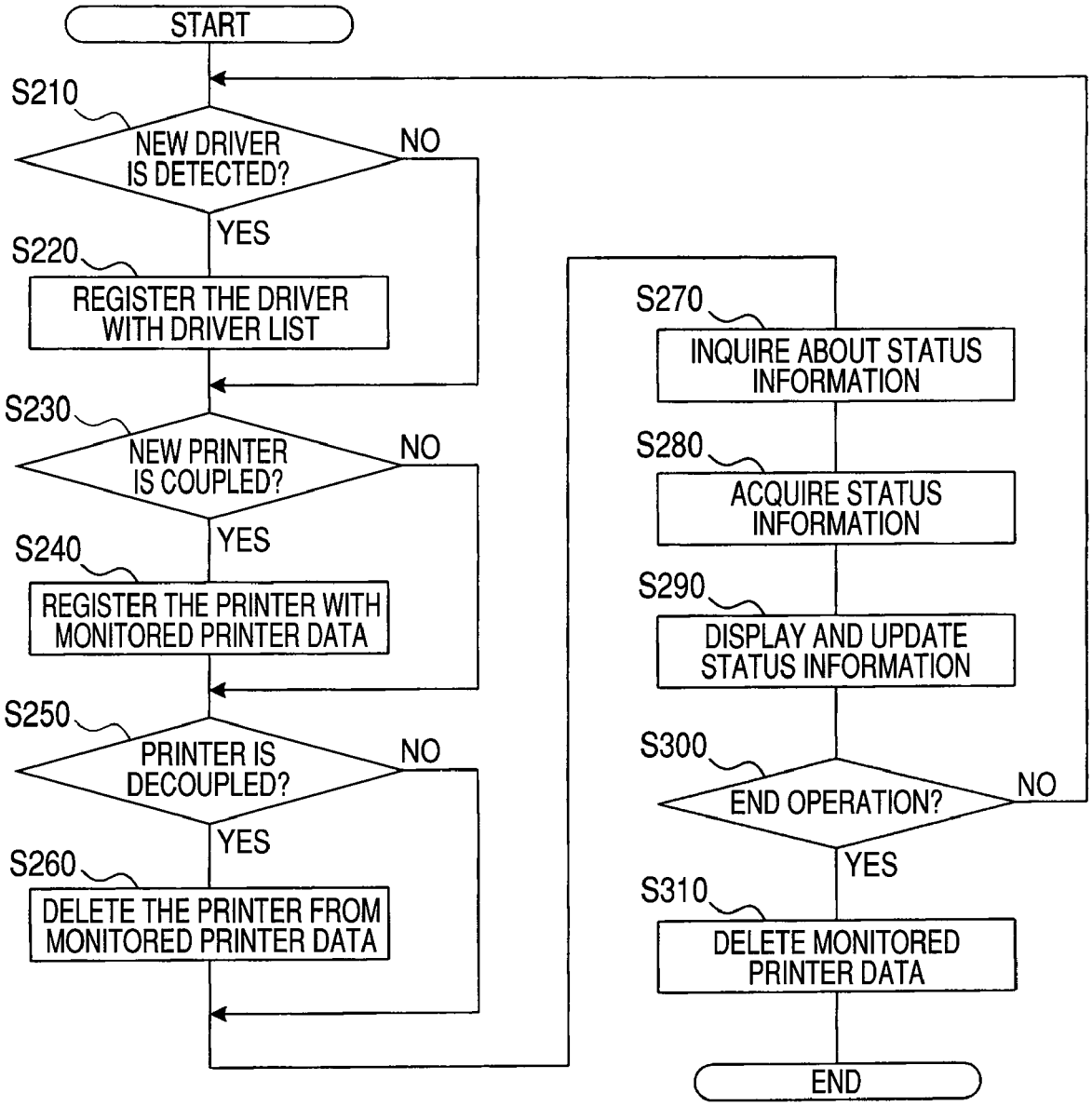
FIG. 5 is a flowchart showing event processing according to an exemplary embodiment.

FIG. 5 is a flowchart showing the event processing according to the first exemplary embodiment. This flow is executed when it is determined in process S160 of the flow shown in FIG. 2 that all the printer drivers registered with the driver list have been selected.

When the event processing shown in FIG. 5 starts, it is determined whether a printer driver (a new printer driver) that has not yet been registered with the driver list is installed in the PC 10 (S210).

Then, when it is determined that a new printer driver is installed in the PC 10 (S210: Yes), the installed printer driver is registered with the driver list (S220).

Then, when process S220 ends or when it is determined in process S210 that a new printer driver is not installed in the PC 10 (S210: No), it is determined whether among those printers 20 which have been registered with the driver list, a printer 20 unregistered with the monitored printer data is coupled to the PC 10 (S230).

Then, when it is determined in process S230 that the printer 20 unregistered with the monitored printer data is coupled (S230: Yes), the printer 20 is registered with the monitored printer data (S240).

Figure 4D:
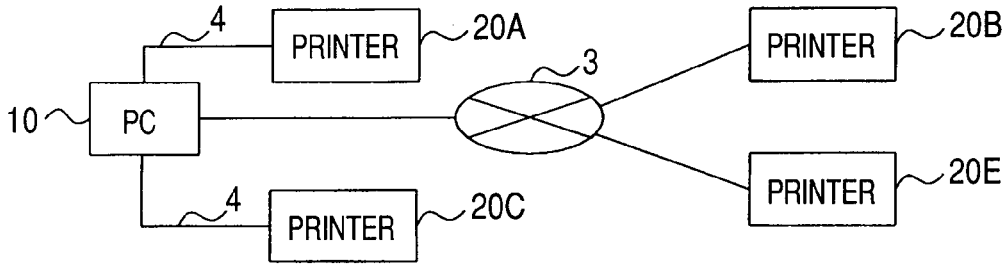

For example, as shown in FIG. 4D, when the printers 20A, 20B, and 20E have been coupled to the PC 10 in which the printer driver A and the printer driver B are registered, and the printer 20C is additionally coupled, the printer 20C is added to (registered with) the monitored printer data.

Then, when the printer 20 additionally coupled in process S240 is registered with the monitored printer data or when it is determined that no printer 20 unregistered with the monitored printer data is coupled (S230: No), it is determined whether the printer 20 having been registered with the monitored printer data is decoupled from the PC 10 (S250).

Then, when it is determined in process S250 that the printer 20 having been registered with the monitored printer data is decoupled from the PC 10 (S250: Yes), the printer 20 is deleted from the monitored printer data (S260). Then, an inquiry is made for the printer 20 registered with the monitored printer data to transmit status information (S270).

On the other hand, when it is determined in process S250 that the printer 20 having been registered with the monitored printer data is not decoupled from the PC 10 (S250: No), process S260 is not carried out but process S270 is executed.

Then, when an inquiry is made in process S270 to the printer 20 about status information, and then the PC 10 acquires the status information transmitted from the printer 20 (S280), the acquired status information is displayed (updated) (S290).

Figure 6:
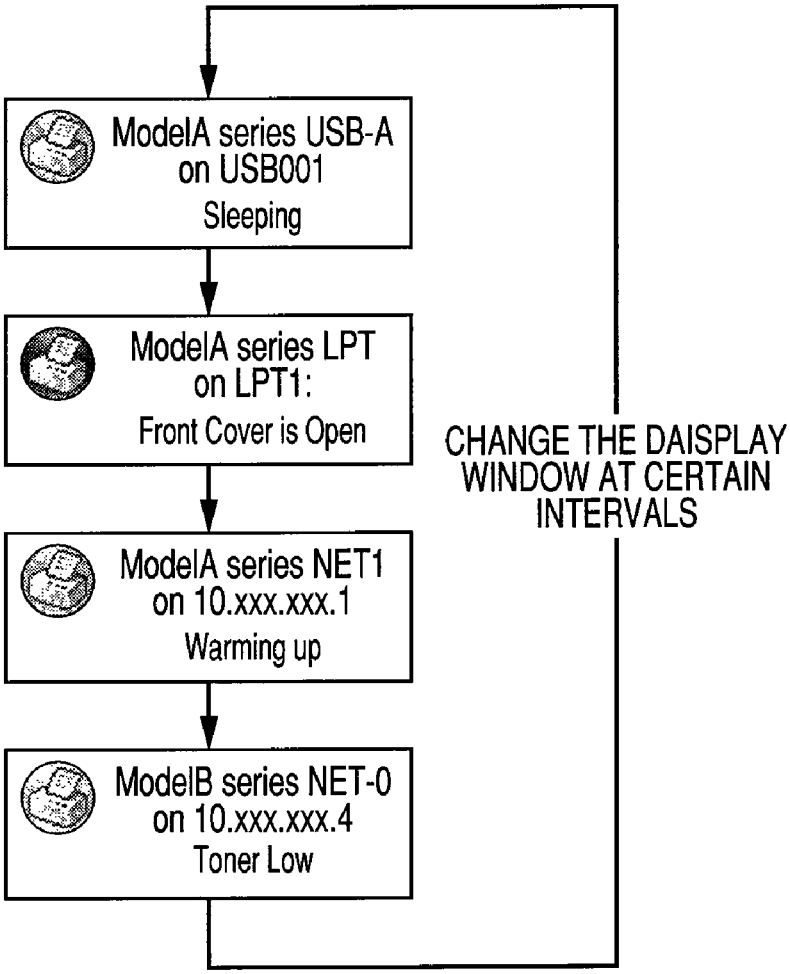
FIG. 6 is an explanatory view illustrating a display window for printer status information according to an exemplary embodiment.

Here, as shown in FIG. 6, in process S290, display images showing related pieces of information are created for each of the printers 20 registered with the monitored printer data. Then, the created display images are sequentially switched and displayed at certain time intervals. These pieces of information include the name of the printer 20, connection information, and status information. Herein, the name of the printer may indicate any information to identify the printer, such as a model No., or an address etc. The connection information indicates whether the printer 20 couples to the PC 10 via the network 3 or directly to the PC 10 via the USB cable 4 or the like.

In the first exemplary embodiment, for example, the contents of the status information transmitted by the printer 20 to the PC 10 may indicate whether the printer 20 controllable by the PC 10 is in a sleep mode or whether the printer 20 is in a warm-up mode in preparation for making it executable for printing. The contents may indicate whether it is in a standby state, whether an error (trouble) has occurred, or may indicate the remaining amount of the toner for forming images.

Subsequently, it is determined whether an end operation is input, for example by a user (S300). If it is determined that the end operation has not been input, then the process returns to S210, where it is determined whether a new printer driver is installed in the PC 10.

On the other hand, when it is determined that the end operations has been input (S290: Yes), all the printers 20 registered with the monitored printer data are deleted (S310), and then the flow ends.

In addition, as end operation, for example, the user may make an entry on the operation unit 12 and thereby end the use status display program that is being executed or may shut down the PC 10.

3. Features of the Image Forming System According to the First Exemplary Embodiment The first exemplary embodiment allows for displaying only the status information that indicates the use status, etc., of the printer 20 corresponding to the printer driver installed in the PC 10 (the printer 20 controllable by the PC 10). Thus, the user can recognize the printer 20 controllable by the PC 10, and the use status of the printer 20 can be provided with improved reliability.

Furthermore, in this exemplary embodiment, when an additional printer driver is installed (YES in S210 shown in FIG. 5), the printer driver is registered with the driver list (S220), and the printer 20 associated with the printer driver can be added to (registered with) the monitored printer data.

Furthermore, in this exemplary embodiment, when the attachment or detachment of the printer 20 is detected (YES in S230 shown in FIG. 5 or YES in S250), the latest status information is displayed. It is thus possible to provide the use status of the printer 20 with further improved reliability.

Furthermore, in this exemplary embodiment, since the latest status information is displayed at certain time intervals, the use status of the printer 20 can be provided with further improved reliability.

Furthermore, in this exemplary embodiment, it is possible to display the latest use status of the printer 20 controllable by the PC 10 in response to the user's selection of the highlighted portion 30 in the menu window shown in FIG. 3.

Furthermore, in this exemplary embodiment, the latest status information is displayed. Accordingly, it is possible to inform the user of a printer 20 having been additionally coupled to the PC 10 and controllable by the PC 10 or a printer 20 having been decoupled from the PC 10 and controllable by the PC 10.

Furthermore, in this exemplary embodiment, since the name of the printer 20 controllable by the PC 10 is displayed on the display device 11, the user can know the use status of each printer 20 at a glance.

Second Exemplary Embodiment

Figure 7:
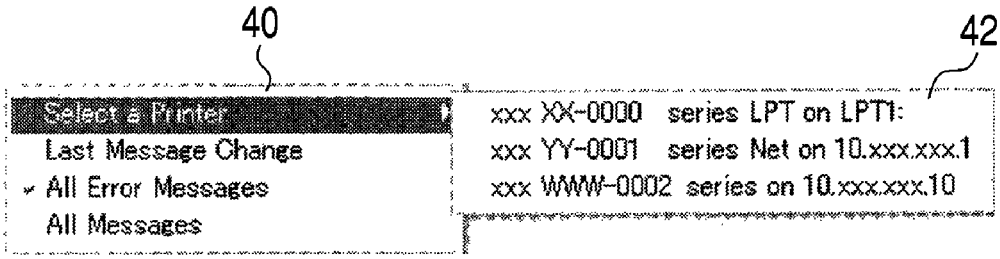
FIG. 7 is an explanatory view illustrating a display window for selectively changing how to display status information according to an exemplary embodiment.

In the first exemplary embodiment, the printers 20 registered with the monitored printer data are sequentially switched to display the status information of each printer 20. However, in a second exemplary embodiment, as shown in FIG. 7, the user can selectively change the way in which the status information is displayed. FIG. 7 is an explanatory view illustrating a display window for selectively changing how to display status information according to the second exemplary embodiment.

Specifically, a display window 40 shown in FIG. 7 includes "Select a Printer", "Last Message Change", "All Error Messages" and "All Message".

In the display window 40, when "Select a Printer" is selected, the printers 20 registered with the monitored printer data are displayed in a list. In a display window 42, at least one of the listed printers 20 can be selected. Then, for the selected printer 20, the status information is displayed as shown in FIG. 6.

When "Last Message Change" is selected, the status information of a printer 20 of those printers 20 registered with the monitored printer data, which has been switched to the latest status (the status information), is sequentially displayed.

Figure 8A:
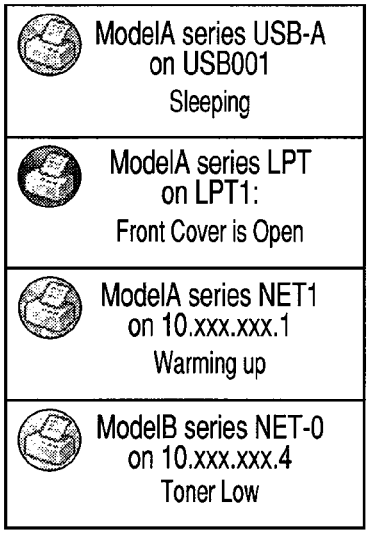
FIGS. 8A to 8C are explanatory views illustrating an image forming system according to a modified exemplary embodiment.
Figure 8B:
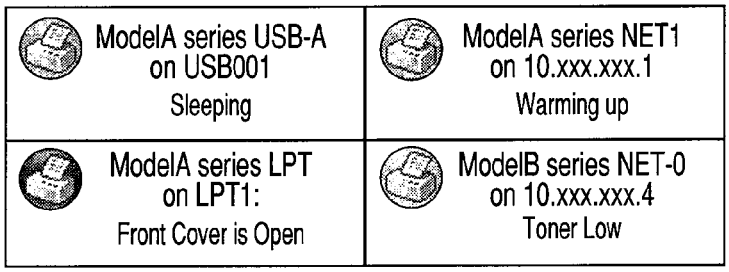
Figure 8C:
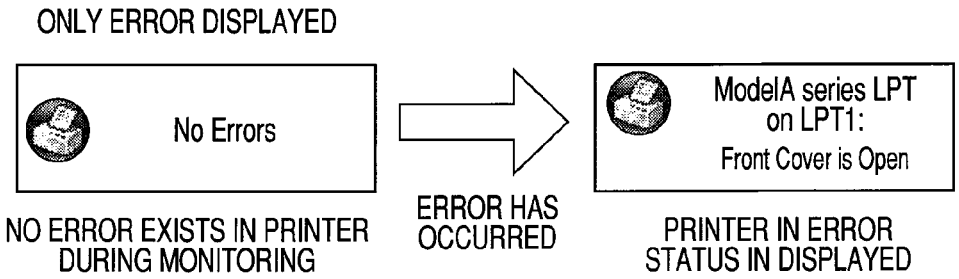

On the other hand, when "All Error Message" is selected as shown in FIG. 8C, displayed is the status information (error information) of a printer of those printers 20 registered with the monitored printer data, in which an error (trouble) has occurred.

As with the first exemplary embodiment, when "All Message" is selected, the status of the printer 20 currently registered with the monitored printer data is displayed.

In the second exemplary embodiment, the display window shown in FIG. 7 can be displayed on the display device 11 after the event processing shown in FIG. 5 is started.

As described above, in the second exemplary embodiment, the way in which the status information is displayed can be selectively changed, for example by a user. It is thus possible to display only the status information of the printer 20 that is required by the user, thereby allowing the usability of the image forming system to be improved.

Third Exemplary Embodiment

In the first exemplary embodiment, status information is displayed without distinguishing between a printer 20 coupled to the PC 10 via the network 3 and a printer 20 directly coupled to the PC 10 not via the network 3 but the USB cable 4 or the like. However, in the third exemplary embodiment, status information is displayed distinguishably between a printer 20 coupled to the PC 10 via the network 3 and a printer 20 directly coupled to the PC 10.

More specifically, in the third exemplary embodiment, the status information of a printer directly coupled to the PC 10 is displayed with a higher priority to the status information of a printer 20 coupled to the PC 10 via the network 3.

That is, the third exemplary embodiment is adapted to detect whether a printer 20 is coupled to the PC 10 via the network 3, so that the detection result is registered with the monitored printer data at the same time the printer 20 is registered therewith. Thus, when status information is displayed in the event processing shown in FIG. 5 (S290), the status information of a printer directly coupled to the PC 10 is displayed with a higher priority to the status information of a printer 20 coupled to the PC 10 via the network 3.

For example, as shown in FIG. 4B, printer 20A is directly coupled to the PC 10 and the printers 20B and 20E are coupled to the PC 10 via the network 3. In this case, the third exemplary embodiment allows for displaying the status information of the printer 20A and thereafter, displaying that of the printers 20B and 20E.

As described above, in the third embodiment, the status information of a printer 20 directly coupled to the PC 10 is displayed with a higher priority to that of a printer 20 coupled to the PC 10 via the network 3. Usually, a directly coupled printer 20 is located closer to the PC 10 than a printer 20 coupled to the PC 10 via the network 3 is. Thus, according to the third exemplary embodiment, a printer 20 located closer to the PC 10 can be displayed with a higher priority. It is thus possible to improve the usability of the image forming system.

Other Exemplary Embodiments

In the exemplary first embodiment, the printers 20 registered with the monitored printer data are sequentially switched to thereby display the status information of each printer 20. However, the present invention is not limited thereto. As shown in FIGS. 8A and 8B, all pieces of status information of the printers 20 registered with the monitored printer data may also be displayed at the same time.

Furthermore, in the first to third exemplary embodiments, a printer 20 whose printer driver is installed is to be monitored, but such a printer that has no printer driver installed may also be monitored. However, in this case, for the user to be able to distinguish between a printer 20 whose printer driver is installed and a printer that has no printer driver installed, an indication "No driver" may be added to the indication of a printer having no printer driver installed. This allows for displaying the status information of those printers 20 distinguishably therebetween.

Furthermore, for example, when the number of printers 20 registered with the monitored printer data is changed, it may be configured to report that.

Furthermore, the PC 10 may search a printer 20, which has a printer driver installed, with the timing at which it is detected that an external device such as the printer 20 is attached (coupled) to or detached (decoupled) from the PC 10.

Furthermore, the PC 10 may search only a printer 20 directly coupled to the PC 10 to display the status information of the printer 20. In this case, when a printer 20 directly coupled to the PC 10 is not found or less in number than predetermined, a printer 20 coupled to the PC 10 via the network 3 may also be searched to display the status information of the printer 20.

In the above-described exemplary embodiments, the USB compliant connection terminal 18 is adopted as a connection terminal. However, the present invention is not limited thereto, and any other compliant connection terminals may also be adopted.

In the above-described exemplary embodiments, the image forming system includes a PC 10 and printers 20 and all processes S110 to S170 and S210 to S310 are executed by CPU 13 of PC10. However, the present invention is not limited thereto, and the image forming system may further include a server apparatus. And, the server apparatus may execute a part of the processes.

While the present invention has been shown and described with reference to certain exemplary embodiments thereof, it will be understood by those skilled in the art that various changes in form and details may be made therein without departing from the spirit and scope of the invention as defined by the appended claims.

What is claimed is:

1. An image forming system comprising:

a computer;

a plurality of image forming apparatuses configured to be coupled to the computer;

a storage unit configured to store driver information of a driver installed in the computer:

a search unit configured to read the driver information, select a driver from the driver information, and search an image forming apparatus corresponding to the selected driver from the plurality of image forming apparatus which are coupled to the computer as being an image forming apparatus controllable by the computer;

a register unit configured to register the searched image forming apparatus in monitored data:

an inquiry unit configured to inquire to the image forming apparatus registered in the monitored data about a use status thereof;

an acquisition unit configured to acquire the use status from the image forming apparatus to which the inquiry unit has inquired; and a display unit configured to display the use status acquired by the acquisition unit.

2. The image forming system according to claim 1, further comprising a detection unit configured to detect if an external device is coupled to or decoupled from the computer, wherein, when the detection unit detects that the external device is coupled to or decoupled from the computer, the search unit searches an image forming apparatus controllable by the computer.

3. The image forming system according to claim 1, wherein the search unit automatically searches an image forming apparatus controllable by the computer at certain time intervals.

4. The image forming system according to claim 1, further comprising an instructing unit configured to receive an instruction to the inquiry unit to start the inquiry, wherein upon receiving the instruction by the instructing unit, the search unit searches an image forming apparatus controllable by the computer.

5. The image forming system according to claim 1, further comprising an informing unit configured to, if a present search result of the search unit is different from a previous search result of the search unit, output information about the difference.

6. The image forming system according to claim 1, wherein the search unit searches an image forming apparatus directly coupled to the computer and controllable by the computer.

7. The image forming system according to claim 1, wherein the display unit displays the use status distinguishably between an image forming apparatus directly coupled to the computer and controllable by the computer, from an image forming apparatus coupled to the computer via a network and controllable by the computer.

8. The image forming system according to claim 7, wherein the display unit displays the use status of the image forming apparatus directly coupled to the computer and controllable by the computer with higher priority than the image forming apparatus coupled to the computer via a network and controllable by the computer.

9. The image forming system according to claim 1, wherein the display unit displays a name of an image forming apparatus controllable by the computer.

10. The image forming system according to claim 9, wherein the display unit displays a name of an image forming apparatus which is controllable by the computer and has a predetermined use status.

11. The image forming system according to claim 10, wherein the display unit displays a name of an image forming apparatus incapable of forming an image.

12. The image forming system according to claim 10, wherein the display unit displays a name of an image forming apparatus of which a use status presently acquired by the acquisition unit is different from a use status previously acquired by the acquisition unit.

13. The image forming system according to claim 1, further comprising a selection unit configured to select an image forming apparatus, a use status of which is to be displayed on the display unit.

14. The image forming system according to claim 1, wherein the use status of the image forming apparatus indicates that the image forming apparatus is in at least one of a sleep mode, a warm-up mode, a standby state, and error state.

15. A computer-readable medium having a computer program stored thereon and readable by a computer configured to couple to a plurality of image forming apparatuses, the computer program, when executed by the computer, causes the computer to perform operations comprising:

reading driver information of a driver installed in the computer:

selecting a driver from the driver information;

searching an image forming apparatus corresponding to the selected driver from the plurality of image forming apparatuses which are coupled to the computer;

registering the searched image forming apparatus in monitored data;

inquiring, to the image forming apparatus registered in the monitored data about a use status thereof;

acquiring the use status from the image forming apparatus, to which the inquiring has been performed; and displaying the acquired use status of the image forming apparatus.

16. An information processing apparatus comprising:

a controller;

a connection portion configured to couple to a plurality of image forming apparatuses;

a storage unit configured to store driver information of a driver installed in the information processing apparatus and monitored data:

a search unit configured to search an image forming apparatus, which the controller is capable of controlling and is coupled to the connection portion, from among the plurality of image forming apparatuses;

a register unit configured to register the image forming apparatus searched by the search unit to the monitored data stored in the storage unit;

an obtaining unit configured to obtain a use status of the image forming apparatus registered in the monitored data; and a display unit configured to display the use status of the image forming apparatus, wherein the search unit is configured to read the driver information from the storage unit, select a driver from the driver information, and search an image forming apparatus corresponding to the selected driver from the plurality of image forming apparatuses which are coupled to the connection portion, as being the image forming apparatus which the controller is capable of controlling and is coupled to the connection portion.

17. The information processing apparatus according to claim 16, further comprising a deletion unit configured to delete an image forming apparatus, which is registered in the monitored data, when the image forming apparatus is decoupled form the connection portion.

* * * * *